United States Patent [19]
Balandin et al.
[11] 4,214,950
[45] Jul. 29, 1980

[54] STEEL FOR NUCLEAR APPLICATIONS

[76] Inventors: Jury F. Balandin, ulitsa Basseinaya, 117, kv.85, Leningrad; Vladimir I. Badanin, ulitsa Gagarina, 12, kv.21, Gatchina Leningradskoi oblasti; Igor V. Gorynin, ulitsa Gromova, 16, kv.50, Leningrad; Lev Y. Gluskin, ulitsa Grafova, 2, kv.37, Leningrad; Jury I. Zvezdin, Kostromskoi prospekt, 42, kv.23, Leningrad; Vladimir A. Nikolaev, ulitsa Radischeva, 14, kv.16, Gatchina Leningradskoi oblasti; Anatoly M. Parshin, prospekt Annikova, 11/1, kv.43, Leningrad; Nikolai N. Zorev, ulitsa Novinki, 6, korpus 2,kv.23, Moscow; Anatoly A. Astafiev, Sharikopodshipnikovskaya ulitsa, 2, kv.34, Moscow; Vladimir S. Dub, ulitsa Festivalnaya, 14, korpus 3, kv.372, Moscow; Oleg M. Vishkarev, ulitsa Sakhalinskaya, 4, kv.72, Moscow; Sergei I. Markov, ulitsa Ferganskaya, 28/7, kv.262, Moscow; Jury V. Sobolev, Novgorodskaya ulitsa, 16, korpus 2, kv.13, Kolpino Leningradskoi oblasti; Valentin I. Kozlov, prospekt Lenina, 41, kv.56, Kolpino Leningradskoi oblasti, all of U.S.S.R.

[21] Appl. No.: 847,799

[22] Filed: Nov. 2, 1977

[51] Int. Cl.[2] ..... C22C 38/42; C22C 38/44; C22C 38/46

[52] U.S. Cl. ..... 176/87; 75/125; 75/128 R; 75/128 P; 75/128 E; 75/128 V; 75/128 W

[58] Field of Search ..... 75/125, 128 E, 128 R, 75/128 V, 128 W, 128 P; 148/36; 176/87

[56] References Cited

U.S. PATENT DOCUMENTS

| | | | |
|---|---|---|---|
| 3,711,340 | 1/1973 | Korchynsky et al. | 75/125 |
| 3,929,472 | 12/1975 | Okada et al. | 75/128 E |
| 4,072,509 | 2/1978 | Zorev et al. | 75/128 V |

FOREIGN PATENT DOCUMENTS

| | | | |
|---|---|---|---|
| 336368 | 5/1972 | U.S.S.R. | 75/128 E |

OTHER PUBLICATIONS

"Irradiation Effects on Reactor Structural Materials" QPR 11/11-1/31/70, Steele et al 2/15/70.

"The Effect of Residual Elements on the Response of Selected Pressure-Vessel Steels and Weldments to Irradiation at 850° F." Potapovs et al. Nuc. App. vol. 6, 1/69, pp. 27-46.

"Demonstration of Improved Radiation Embrittlement Resistance of A533-B Steel Through Control of Selected Residual Elements," Hawthorne, 5/70.

"Trends in Charpy-V Shelf Energy Degradation and Field Strength Increase of Neutron-Embrittled Pressure Vessel Heads," Hawthorne, Nuc. Eng. & Des. 11(1970) 427-446.

70 Met 3m ASME, pp.2-8, Hawthorne, "Experimental Development of Radiation Resistant 85,000 psi Field Strength Reactor Vessel Low Alloy Steel Filler Metal (Pre-Irradiation Evaluation".

*Primary Examiner*—Arthur J. Steiner
*Attorney, Agent, or Firm*—J. Harold Nissen

[57] ABSTRACT

The steel according to the invention consists of 0.12-0.20% by weight of carbon, 0.15-0.37% by weight of silicon, 0.3-0.8% by weight of manganese, 1.6-2.7% by weight of chromium, 0.8-2.0% by weight of nickel, 0.5-1.0% by weight of molybdenum, 0.05-0.15% by weight of vanadium, 0.002-0.08% by weight of cerium, 0.01-0.10% by weight of copper, 0.0005-0.009% by weight of antimony, 0.0005-0.009% by weight of tin, 0.001-0.02% by weight of sulphur, 0.002-0.02% by weight of phosphorus, 96.246-92.862% by weight of iron.

The steel exhibits improved resistance against neutron radiation. At 300° C. and neutron fluence of $1.10^{20}$ neutr./cm$^2$, the transition embrittlement temperature increases by no more than 50° C. The steel is designed for application in structural members having a wall thickness of up to 650 mm and has ultimate strength $\sigma_B$ at 350° C. of at least 55 kgf/mm$^2$. The steel does not require immediate temper after welding.

7 Claims, No Drawings

STEEL FOR NUCLEAR APPLICATIONS

The present invention relates to the metal production, and more particularly, to the steel production.

Field of the Invention

The steel according to the invention is to be used in the manufacture of casings of energy and propulsion nuclear reactors operating under high pressure of heat carrier.

BACKGROUND OF THE INVENTION

Known in the art is steel consisting of 0.13% by weight of carbon, 0.15–0.30% by weight of silicon, 0.30–0.55% by weight of manganese, 1–1.5% by weight of chromium, 1.0–1.6% by weight of nickel, 0.5–0.7% by weight of molybdenum, 0.01–0.10% by weight of vanadium, 0.02–0.04% by weight of cerium, sulphur and phosphorus in a quantity of less than or equal to 0.020% by weight, iron- the balance. Such steel possesses high mechanical properties (yield strength of 50 kg/mm$^2$); however, it is prone to embrittlement under the action of neutron radiation (transition embrittlement temperature $T_k$ increases by 120°–160° C. with neutron fluence of about $1.10^{20}$ neutr./cm$^2$). In addition, the prior art steel cannot be used for making structural members having a wall thickness exceeding 400 mm due to insufficient hardening depth.

Known in the art is also steel consisting of 0.11–0.25% by weight of carbon, 0.17–0.37% by weight of silicon, 0.3–0.6% by weight of manganese, 2–3% by weight of chromium, 0.6–0.8% by weight of molybdenum, 0.25–0.35% by weight of vanadium, a quantity of sulphur and phosphorus less than or equal to 0.025% by weight, iron- the balance. The steel exhibits high strength (yield strength equal to or less than 55 kg/mm$^2$) and good resistance against radiation (an increase in the transition embrittlement temperature $\Delta T_k$ is less than or equal to 60° C. with a neutron fluence of about $1.10^{20}$ neutr./cm$^2$). This steel cannot, however, be used for the manufacture of structural members with a wall thickness exceeding 400 mm, and welding of such members is associated with difficulties because an accompanying heating at 300°–350° C. and immediate tempering are required after the welding.

Known in the art is steel consisting of 0.25% by weight of carbon, 0.15–0.3% by weight of silicon, 0.5–1.5% by weight of manganese, 0.4–0.7% by weight of nickel, 0.45–0.6% by weight of molybdenum, 0.04% by weight of sulphur, 0.035% by weight of phosphorus, iron- the balance. This steel features good manufacturing properties and weldability, but is characterized by low strength (yield strength equal to or less than 35 kg/mm$^2$), is embrittled under the action of neutron radiation ($\Delta T_k$=100°–200° C. with a fluence of neutrons of about $5.10^{19}$ neutr./cm$^2$).

Also known in the art is steel containing 0.20% by weight of carbon, 0.020–0.3% by weight of silicon, 0.4% by weight of manganese, 1.5–2.0% by weight of chromium, 3–4% by weight of nickel, 0.45–0.60% by weight of molybdenum, 0.03% by weight of vanadium, ≦0.02% by weight of sulphur and phosphorus, iron- the balance.

This steel exhibits high strength (yield strength equal to or less than 60 kgf/mm$^2$) and high toughness, it is good for welding. However, this steel is prone to embrittlement under heat and radiation action ($\Delta T_k$=100°–150° C. with a fluence of neutrons of about $5.10^{19}$ neutr./cm$^2$).

It is an object of the invention to eliminate the above disadvantages.

The main object of the invention is to provide steel to be used in the manufacture of casings of nuclear reactors which exhibits an improved resistance against the action of neutron radiation.

Another object of the invention is to provide steel which exhibits an improved hardening depth.

The invention consists in the provision of steel containing such components and in such proportions as to improve the resistance of steel against the action of neutron radiation and increase hardening depth of the steel.

SUMMARY OF THE INVENTION

The above objects are accomplished by that steel containing carbon, silicon, manganese, chromium, nickel, molybdenum, vanadium, cerium, sulphur, phosphorus and iron, according to the invention, additionally contains copper, antimony and tin, the above-mentioned components being used in the following quantities, in % by weight:

| | |
|---|---|
| carbon | 0.12–0.20 |
| silicon | 0.15–0.37 |
| manganese | 0.3–0.8 |
| chromium | 1.6–2.7 |
| nickel | 0.8–2.0 |
| molybdenum | 0.5–1.0 |
| vanadium | 0.05–0.15 |
| cerium | 0.002–0.08 |
| sulphur | 0.001–0.02 |
| phosphorus | 0.002–0.02 |
| copper | 0.01–0.1 |
| antimony | 0.0005–0.009 |
| tin | 0.0005–0.009 |
| iron | the balance |

According to the invention, a total content of antimony and tin in the steel is preferably from 0.001 to 0.01% by weight.

Due to the present invention it is now possible to provide steel exhibiting an improved resistance against neutron radiation. At 300° C. and fluence of neutrons of $1.10^{20}$ neutr./cm$^2$ (E>0.5 MeV), the transition embrittlement temperature is increased by no more than 50° C. The steel can be used in structural members with a wall thickness of up to 650 mm and has an ultimate strength $\sigma_B$ at 350° C. of at least 55 kgf/mm$^2$. The steel does not require immediate tempering after welding.

Further objects and advantages of the invention will become apparent from the following detailed description of the steel and preferred embodiments of the invention.

DETAILED DESCRIPTION

The steel according to the invention has the following composition: 0.12–0.20% by weight of carbon, 0.15–0.37% by weight of silicon, 0.3–0.8% by weight of manganese, 1.6–2.7% by weight of chromium, 0.8–2.0% by weight of nickel, 0.5–1.0% by weight of molybdenum, 0.05–0.15% by weight of vanadium, 0.002–0.08% by weight of cerium, 0.01–0.10% by weight of copper, 0.0005–0.009% by weight of antimony, 0.0005–0.009% by weight of tin, 0.001–0.02% by weight of sulpur, 0.002–0.020% by weight of phosphorus, 96.246–92.862% by weight of iron.

The above-mentioned contents of copper, antimony and tin, in combination, impart to the steel according to the invention resistance against radiation-induced embrittlement.

Carbon content in the steel is from 0.12 to 0.20% by weight. With a carbon content in the steel at least 0.12% by weight, time resistance of at least 62 kgf/mm$^2$ is ensured at 20° C. For good welding properties of the steel, carbon content is not to exceed 0.20% by weight.

Silicon and manganese are used in quantities providing for complete deoxidation of steel. The upper limit of their content is defined by the above-mentioned values to prevent lowering of toughness of the steel.

Chromium content of at least 1.6% by weight provides for required strength and toughness of the steel with a wall thickness of up to 650 mm. With chromium content not exceeding 2.7% by weight, good weldability of the steel is ensured.

Nickel is used in the steel as the element which is most favorable for improving hardening depth and toughness of steel. However, nickel content in steel is not to exceed 2.0% by weight so as to avoid negative influence of nickel on radiation stability of the steel.

Molybdenum content is within the range providing for elimination of the tempering embrittlement, as well as for increasing the hardening depth of steel which is required to obtain high strength and plasticity.

Vanadium is used as the element favouring the formation of fine-grained structure, bonding of nitrogen and improving tempering stability of steel. The upper limit of vanadium content of 0.15% by weight is defined by welding conditions.

Cerium is used to improve deformability of the steel in forging and rolling of large-sized ingots. The upper limit of cerium content (0.08% by weight) is defined by the danger of contamination of steel with cerium oxides which may impair deformability and induce the appearance of flaws.

The contents of sulphur and phosphorus within the above-mentioned ranges contribute to additional improvement of toughness of the steel.

The steel having the above composition is manufactured in the form of ingots weighing up to 160 tons and may be used in forgings and sheets. After hardening and tempering, the steel has the following guaranteed mechanical properties with a wall thickness of up to 650 mm:

| | |
|---|---|
| at 20° C.- | yield strength $\sigma_T \geqq 55$ kgf/mm$^2$<br>time resistance $\sigma_B \geqq 62$ kgf/mm$^2$<br>percentage elongation $\delta \geqq 15\%$<br>percentage reduction in area $\psi \geqq 55\%$ |
| at 350° C.- | $\sigma_T \geqq 45$ kgf/mm$^2$<br>$\sigma_B \geqq 55$ kgf/mm$^2$<br>$\delta \geqq 14\%$<br>$\psi \geqq 50\%$. |

The steel may be welded by automatic, manual or electroslag remelting methods. There is no need for immediate tempering after welding and corrosion resistance surfacing.

Transition embrittlement temperature $T_k$ determined by the work of destruction of V-notched Sharp samples equal to 4.8 kgm is not below −40° C. in the initial state, an increase of $T_k$ after irradiation at 275° to 300° C. with different fluences is as follows:

| | |
|---|---|
| $1.10^{19}$ neutr./cm$^2$ | $\leqq 20°$ |
| $5.10^{19}$ neutr./cm$^2$ | $\leqq 30°$ |
| $1.10^{20}$ neutr./cm$^2$ | $\leqq 50°$. |

Upon the above-mentioned changes in the transition temperature, the steel fully complies with the requirements as to resistance against radiation embrittlement imposed by the Rules on Strength Calculations of Thick-Walled Containment Structures for Atomic Power Plants adopted in the USSR and abroad. According to these Rules, the use of the steel will ensure safe operation of casings of water-water reactors during at least 30 years with a fluence of neutrons at the casing wall of at least $1.10^{20}$ neutr./cm$^2$.

EXAMPLE 1

The steel having the following composition (in % by weight) was tested: carbon-0.12, silicon-0.27, manganese-0.48, chromium-2.47, nickel-1.14, molybdenum-0.56, vanadium-0.12, cerium (from calculation)-0.01, sulphur-0.011, phosphorus-0.009, copper-0.03, antimony-0.001, tin-0.002, iron-the balance. After a heat treatment under conditions simulating quenching and high temper with the thickness of 650 mm, the steel had yield strength $\sigma_T = 59.1$ kgf/mm$^2$ at room temperature. Transition embrittlement temperature was $T_k = -90°$ (with 5×5×27.5 mm samples with 1 mm V-notch).

After irradiation with neutron fluence $F = 9.7.10^{19}$ neutr./cm$^2$($E \geqq 0.5$ MeV) at 275°-320° C., the transition temperature increased by no more than 10°.

EXAMPLE 2

The steel having the following composition (in % by weight) was tested: carbon-0.12, silicon-0.27, manganese-0.48, chromium-2.47, nickel-1.14, molybdenum-0.56, vanadium-0.12, cerium (from calculation)-0.01, sulphur-0.011, phosphorus-0.009, copper-0.06, antimony-0.001, tin-0.02, iron-the balance. After a heat treatment under conditions simulating quenching and high temper with the thickness of 650 mm, the steel had yield strength $\sigma_T = 58.7$ kgf/mm$^2$ at room temperature. Transition temperature $T_k = -90°$ C. (with 5×5×27.5 mm samples). After irradiation with neutron fluence rate $F = 9.7.10^{19}$ neutr./cm$^2$ at 275°-320° C., the transition temperature increased by no more than 10°.

EXAMPLE 3

The steel having the following composition (in % by weight) was tested: carbon-0.12, silicon-0.27, manganese-0.48, chromium-0.47, nickel-1.14, molybdenum-0.56, vanadium-0.12, sulphur-0.011, phosphorus-0.009, copper-0.08, antimony-0.001, tin-0.002, cerium (from calculation)-0.01, iron-the balance. After a heat treatment of a sample of this steel under conditions simulating quenching and high temper with the thickness of 650 mm, the steel had yield strength $\sigma_T = 59.6$ kgf/mm$^2$ at room temperature. Transition embrittlement temperature $T_k = -90°$ C. (with 5×5×27.5 mm samples with V-notch of 1 mm). After irradiation with neutron fluence of $9.7.10^{19}$ neutr.cm$^2$ ($E \geqq 0.5$ MeV) at 275°-320° C., the transition temperature increased by no more than 10° C.

EXAMPLE 4

The steel having the following composition (in % by weight) was tested: carbon-0.12, silicon-0.27, manganese-0.48, chromium-2.47, nickel-1.14, molybdenum-0.56, vanadium-0.12, sulphur-0.011, phosphorus-0.009, copper-0.08, antimony-0.007, tin-0.002, cerium (from calculation)-0.01, iron-the balance. After a heat treatment of a sample of this steel under conditions simulating hardening and high temper with the thickness of 650 mm, the steel had yield strength $\sigma_T$=59.9 kgf/mm$^2$ at room temperature (20° C.). The transition embrittlement temperature $T_k$=−80° C. (with 5×5×27.5 mm samples with V-notch of 1 mm). After irradiation with neutron fluence of 9.7.10$^{19}$ neutr./cm$^2$ (E≧0.5 MeV) at 275°-320° C. the transition temperature increased by 30° C.

EXAMPLE 5

The steel having the following composition (in % by weight) was tested: carbon-0.12, silicon-0.27, manganese-0.48, chromium-2.47, nickel-1.14, molybdenum-0.56, vanadium-0.12, sulphur-0.011, phosphorus-0.009, copper-0.08, antimony-0.007, tin-0.009, cerium (from calculation)-0.01, iron-the balance. After a heat treatment of samples of this steel under conditions simulating quenching and high temper with the thickness of 650 mm, the steel had yield strength $\sigma_T$=59.6 kgf/mm$^2$ at room temperature (20° C.). The transition embrittlement temperature was $T_k$=−80° C. (with 5×5×27.5 mm samples with V-notch of 1 mm). After irradiation with neutron fluence of 9.7.10$^{19}$ neutr./cm$^2$ (E≧0.5 MeV) at 275°-320° C. the transition temperature increased by 40° C.

EXAMPLE 6

The steel having the following composition (in % by weight) was tested: carbon-0.17, silicon-0.21, manganese-0.34, chromium-1.87, nickel-1.67, molybdenum-0.82, vanadium-0.08, sulphur-0.013, phosphorus-0.008, copper-0.02, antimony-0.001, tin-0.001, cerium (from calculation)-0.01, iron-the balance. After a heat treatment of a sample of this steel under conditions simulating quenching and high temper with the thickness of 650 mm, the steel had yield strength $\sigma_T$=61.6 kgf/mm$^2$ at room temperature (20° C.). The transition embrittlement temperature $T_K$=−110° C. (with 5×5×27.5 mm samples with V-notch of 1 mm). After irradiation with neutron fluence of 1.2.10$^{20}$ neutr./cm$^2$ at 285°-310° C. the transition temperature did not change.

EXAMPLE 7

The steel having the following composition (in % by weight) was tested: carbon-0.17, silicon-0.21, manganese-0.34, chromium-1.87, nickel-1.67, molybdenum-0.82, vanadium-0.08, sulphur-0.013, phosphorus-0.008, copper-0.02, antimony-0.008, tin-0.002, cerium (from calculation)-0.01, iron-the balance. After a heat treatment of a sample of this steel under conditions simulating quenching and high temper with the thickness of 650 mm, the steel had yield strength $\sigma_T$=62.7 kgf/mm$^2$ at room temperature (20° C.). The transition embrittlement temperature $T_K$=−100° C. (with 5×5×27.5 mm samples with V-notch of 1 mm). After irradiation with neutron fluence rate of 1.2.10$^{20}$ neutr./cm$^2$ at 285°-310° C. the transition temperature increased by 20° C.

EXAMPLE 8

The steel having the following composition (in % by weight) was tested; carbon-0.17, silicon-0.21, manganese-0.34, chromium-1.87, nickel-1.67, molybdenum-0.82, vanadium-0.08, sulphur-0.013, phosphorus-0.008, copper-0.02, antimony-0.008, tin-0.007, cerium-(from calculation)-0.01, iron-the balance. After a heat treatment of a sample of this steel under conditions simulating quenching and high temper with the thickness of 650 mm, the steel had yield strength $\sigma_T$=63.1 kgf/mm$^2$ at room temperature. Transition embrittlement temperature $T_K$=−90° C. (with 5×5×27.5 mm samples with V-notch of 1 mm). After irradiation with neutron fluence of 1.2.10$^{20}$ neutr./cm$^2$ at 285°-310° C., the transition temperature increased by 20° C.

EXAMPLE 9

The steel having the following composition (in % by weight) was tested: carbon-0.17, silicon-0.21, manganese-0.34, chromium-1.87, nickel-1.67, molybdenum-0.82, vanadium-0.08, sulphur-0.013, phosphorus-0.008, copper-0.10, antimony-0.008, tin-0.007, cerium (from calculation)-0.01, iron-the balance. After a heat treatment under conditions simulating quenching and high temper with the thickness of 650 mm, the steel had yield strength $\sigma_T$=63.2 kgf/mm$^2$ at room temperature. Transition embrittlement temperature $T_K$=−90° C. (with 5×5×27.5 mm samples with V-notch of 1 mm). After irradiation with neutron fluence of 1.2.10$^{20}$ neutr./cm$^2$ at 285°-310° C., the transition temperature increased by 30° C.

EXAMPLE 10

The steel having the following composition (in % by weight) was tested: carbon-0.18, silicon-0.32, manganese-0.55, chromium-2.31, nickel-1.19, molybdenum-0.70, vanadium-0.06, sulphur-0.007, phosphorus-0.011, copper-0.06, antimony-0.002, tin-0.0005, cerium (from calculation)-0.02, iron-the balance. After a heat treatment of a sample of this steel under conditions simulating quenching and high temper with the thickness of 650 mm, the steel had yield strength $\sigma_T$=58.3 kgf/mm$^2$ at room temperature. The transition embrittlement temperature $T_k$=−80° C. (with 5×5×27.5 mm samples with V-notch of 1 mm). After irradiation with neutron fluence of 1.2.10$^{20}$ neutr./cm$^2$ at 285°-310° C., the transition temperature increased by no more than 10° C.

EXAMPLE 11

The steel having the following composition (in % by weight) was tested: carbon-0.18, silicon-0.32, manganese-0.55, chromium-2.31, nickel-1.19, molybdenum-0.70, vanadium-0.06, sulphur-0.007, phosphorus-0.011, copper-0.06, antimony-0.002, tin-0.004, cerium (from calculation)-0.02, iron-the balance. After a heat treatment of a sample of this steel under conditions simulating hardening and high tempering with the thickness of 650 mm, the steel had yield strength $\sigma_T$=59.3 kgf/mm$^2$ at room temperature. The transition embrittlement temperature $T_k$=−80° C. (with 5×5×27.5 mm samples with V-notch of 1 mm). After irradiation with neutron fluence of 1.2.10$^{20}$ neutr./cm$^2$ at 285°-310° C., the transition temperature increased by no more than 10° C.

EXAMPLE 12

The steel having the following composition (in % by weight) was tested: carbon-0.18, silicon-0.32, manganese-0.55, chromium-2.31, nickel-1.19. molybdenum-0.07, vanadium-0.06, cerium (from calculation)-0.02, sulphur-0.007, phosphorus-0.011, copper-0.06, antimony-0.007, tin-0.004, iron-the balance. After a heat treatment of a sample of this steel under conditions simulating quenching and high temper with the thickness of 650 mm, the steel had yield limit $\sigma_T = 57.9$ kgf/mm$^2$ at room temperature. The transition embrittlement temperature $T_k = -80°$ C. (with $5 \times 5 \times 27.5$ mm samples with V-notch of 1 mm). After irradiation with neutron fluence of $1.2.10^{20}$ neutr./cm$^2$ at 285°–310° C., the transition temperature increased by 30° C.

EXAMPLE 13

The steel having the following composition (in % by weight) was tested: carbon-0.18, silicon-0.32, manganese-0.55, chromium-2.31, nickel-1.19, molybdenum-0.70, vanadium-0.06, cerium (from calculation)-0.02, sulphur-0.007, phosphorus-0.011, copper-0.06, antimony-0.007, tin-0.008, iron-the balance. After a heat treatment of a sample of this steel under conditions simulating quenching and high temper with the thickness of 650 mm, the steel had yield limit $\sigma_T = 58.2$ kgf/mm$^2$ at room temperature (20° C.). The transition embrittlement temperature $T_k = -80°$ C. (with $5 \times 5 \times 27.5$ mm samples with V-notch of 1 mm). After irradiation with neutron fluence of $1.2.10^{20}$ neutr./cm$^2$ at 285°–310° C., the transition temperature increased by 50° C.

What is claimed is:

1. Steel consisting of the following components, in % by weight:

| | |
|---|---|
| carbon | 0.12–0.20 |
| silicon | 0.15–0.37 |
| manganese | 0.3–0.8 |
| chromium | 1.6–2.7 |
| nickel | 0.8–2.0 |
| molybdenum | 0.5–1.0 |
| vanadium | 0.05–0.15 |
| cerium | 0.002–0.08 |
| copper | 0.01–0.10 |
| antimony- | 0.0005–0.009 |
| tin | 0.0005–0.009 |
| sulphur | 0.001–0.02 |
| phosphorus | 0.002–0.02 |
| iron | 96.246–92.862. |

2. Steel according to claim 1, wherein the total content of antimony and tin is from 0.001 to 0.01% by weight.

3. The steel as claimed in claim 1, wherein the total content in weight percent of the antimony and tin is between 0.001 and 0.01; and, with a wall thickness of 650 mm, at a temperature of 20° C., the steel has

| | |
|---|---|
| a yield strength | ≧55 kgf/mm$^2$ |
| a timeresistance | ≧62 kgf/mm$^2$ |
| a percentage elongation | ≧15%, and |
| a percentage reduction in area | ≧55%; and |

at 350° C., the steel has

| | |
|---|---|
| a yield strength | ≧45 kgf/mm$^2$ |
| a time resistance | ≧55 kgf/mm$^2$ |
| a percentage elongation | ≧14%, and |
| a percentage reduction in area | ≧50%. |

4. The steel as claimed in claim 1, wherein said steel has a weight, time resistance of at least 62 kgf/mm$^2$ at 20° C. and good welding properties.

5. A casing of a nuclear reactor, said casing being made of a steel consisting of the following components in weight percent:

| | |
|---|---|
| carbon | 0.12–0.20 |
| silicon | 0.15–0.37 |
| manganese | 0.3–0.8 |
| chromium | 1.6–2.7 |
| nickel | 0.8–2.0 |
| molybdenum | 0.5–1.0 |
| vanadium | 0.05–0.15 |
| cerium | 0.002–0.08 |
| copper | 0.01–0.10 |
| antimony | 0.0005–0.009 |
| tin | 0.0005–0.009 |
| sulphur | 0.001–0.02 |
| phosphorus | 0.002–0.02 |
| iron | 96.246–92.862. |

6. The casing as claimed in claim 5, said casing having a wall thickness between 400 mm and 650 mm.

7. The casing as claimed in claim 5, wherein the total content of the antimony and the tin is from 0.001 to 0.01 percent by weight, and after hardening and tempering the steel at 20° C. has a yield strength equal to or greater than 55 kgf/mm$^2$, a time resistance equal to or greater than 62 kgf/mm$^2$, a percentage elongation equal to or greater than 15%, and a percentage reduction in area equal to or greater than 55%, and at 350° C., the steel has a yield strength equal to or greater than 45 kgf/mm$^2$, a time resistance equal to or greater than 55 kgf/mm$^2$, a percentage elongation equal to or greater than 14%, and a percentage reduction in area equal to or greater than 50%.

* * * * *

UNITED STATES PATENT AND TRADEMARK OFFICE

CERTIFICATE OF CORRECTION

PATENT NO. : 4,214,950

DATED : July 29, 1980

INVENTOR(S) : STEEL FOR NUCLEAR APPLICATIONS

It is certified that error appears in the above—identified patent and that said Letters Patent is hereby corrected as shown below:

Column 6, Line 64 (Example 12) change "0.07" to --0.70--

Signed and Sealed this

*Twenty-eighth* Day of *October 1980*

[SEAL]

*Attest:*

SIDNEY A. DIAMOND

*Attesting Officer*

*Commissioner of Patents and Trademarks*